United States Patent [19]

Horton

[11] 4,207,683

[45] Jun. 17, 1980

[54] CLOTHES DRYER

[76] Inventor: Roberta J. Horton, 9393 Hackamore Dr., Boise, Id. 83705

[21] Appl. No.: 8,415

[22] Filed: Feb. 1, 1979

[51] Int. Cl.[2] ..... F26B 11/04

[52] U.S. Cl. ..... 34/60; 34/90; 68/58; 134/163; 34/133

[58] Field of Search ..... 34/90, 133, 60; 68/20, 68/58; 134/151, 163, 198

[56] References Cited

U.S. PATENT DOCUMENTS

| | | | |
|---|---|---|---|
| 2,812,593 | 11/1957 | Olthius | 68/20 |
| 3,180,037 | 4/1965 | Kenreich et al. | 68/20 |
| 3,338,072 | 8/1967 | Brillet | 68/20 |
| 3,401,052 | 9/1968 | Berger et al. | 68/20 |
| 3,583,180 | 6/1971 | Arbogast | 68/20 |
| 4,007,546 | 2/1977 | Sauer | 340/133 |

*Primary Examiner*—Larry I. Schwartz
*Attorney, Agent, or Firm*—Paul F. Horton

[57] ABSTRACT

An improvement on conventional clothes dryers including a spray nozzle, a control valve, and a water line coupled to an existing water source. The touch-up spray is used for removal of wrinkles from clothing and fabrics and permanent press clothing in particular without removing a garment's factory set creases. The apparatus may also include a water heating unit for spraying water of a selected temperature or steam. The apparatus may further be provided with a liquid additive dispenser for dispensing static electricity removal agents and clothes softening fluids.

5 Claims, 3 Drawing Figures

CLOTHES DRYER

BACKGROUND OF THE INVENTION

1. Field of the Invention

This invention relates in general to clothes dryers and, in particular to improvements in clothes dryers.

2. Description of the Prior Art

The problem of obtaining wrinkle free permanent press articles from automatic clothes dryers has long been recognized. If the clothes are removed from the dryer immediately after tumble drying the problem is obviated. Most often, the clothes are allowed to remain in the dryer because of the absence of the operator. Hot permanent press articles wrinkle quickly if allowed to set in the drum at the end of a cycle, and will wrinkle even when cool if left in the dryer for an extended period of time. In attempting to overcome this problem, many dryers tumble without heat for a period of five to ten minutes to allow the drum enclosed therein to cool down before coming to a halt. Additionally, some dryers are provided with buzzers to warn the operators that the cycle is about to end. Other dryers tumble for an extended period giving intermitten aural signals to alert the operator. Frequently however, the operator is not within hearing distance of the signal or is occupied with other household chores and can not respond.

SUMMARY OF THE INVENTION

The present invention provides apparatus for spraying clean water on wrinkled fabrics within the dryer for quick removal of the wrinkles by tumbling. The apparatus may also provide means for heating the water so sprayed and for dispensing desired additives. A more thorough description of the invention may be found in the appended claims.

It is therefore a primary object of the present invention to provide apparatus for spraying a desired amount of water on clothes within a dryer for removal of wrinkles.

More specifically, it is an object of the present invention to provide apparatus for spraying water of a selected temperature on fabrics within a dryer for removal of wrinkles.

A still further object of the present invention is to spray water and a desired liquid additive on fabrics within a dryer for the removal of wrinkles.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
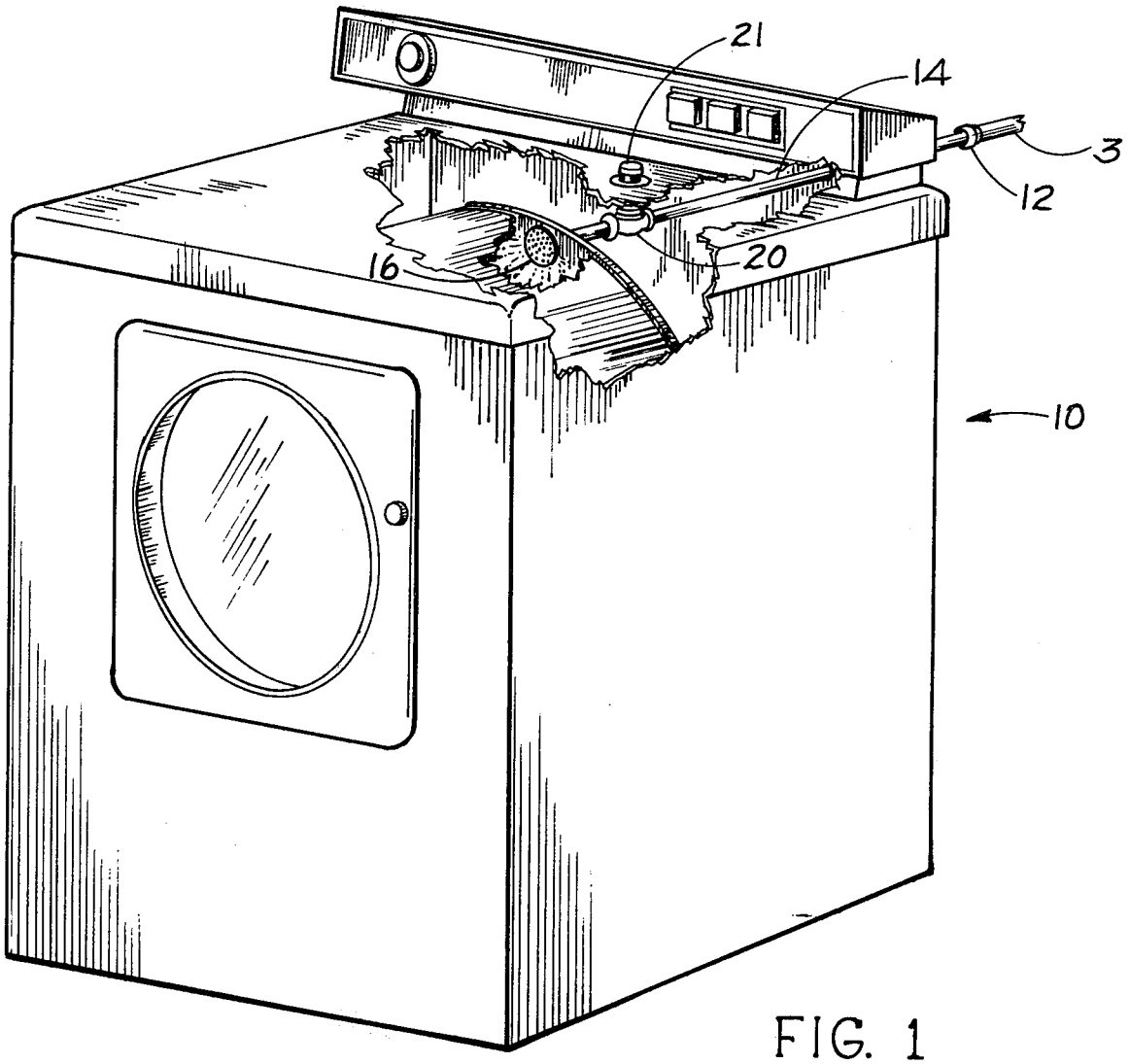
FIG. 1 is a perspective view of a dryer including one embodiment of the improvement of the present invention.
Figure 2:
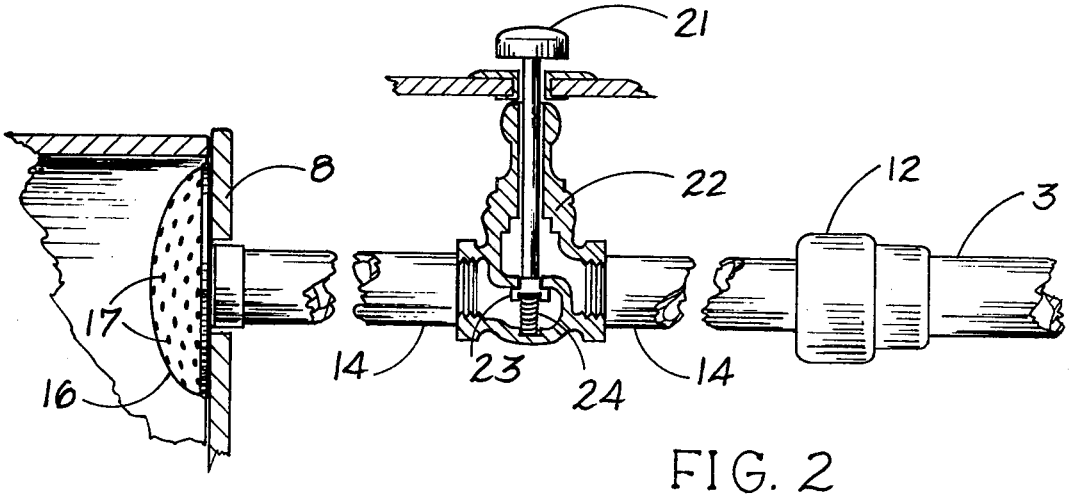
FIG. 2 is a sectional side view of the apparatus of FIG. 1.

Referring now to the drawings, and more particularly to FIGS. 1 and 2, one embodiment to be preferred of an improved dryer 10 made according to the present invention is disclosed. Improved dryer 10 includes a water hookup coupler 12, water pipe 14, spray nozzle 16, and control valve 20.

Coupler 12, at one end, clamps or screws on to a flexible hose or pipe 3 for obtaining water from an external source such as the hot or cold water tap, and at the other end is attached to pipe 14. Pipes used in the present invention may be formed of any suitable material such as copper, plastic, or galvanized steel.

Valve 20, shown to better advantage in FIG. 2, may be a gate valve, globe valve, plug valve, or any other conventional valve suited for the purpose. One suitable valve, as shown in FIG. 2, is a spring loaded button controlled valve which permits a desired volume of water to be discharged through nozzle 16 very rapidly. Valve 20 may be provided with a pushbutton 21 extending through valve housing 22 and controlling a disk 23 forced into a closed position by compression spring 24. Depression of button 21 displaces disk 23 downwardly allowing water flow through the valve and hence through nozzle 16.

Nozzle 16 is seated tightly against backwall 8 of dryer 10 to prevent obstruction with clothes within the dryer. Nozzle 16 is preferably disc-shaped having a convex forwardly facing surface. The convex surface is provided with a multiplicity of extremely narrow apertures 17, in the preferred embodiment, so that water forced through the nozzle, under pressure, produces a fine mist for dampening the clothes. Nozzle 16 is attached to pipe 14 in conventional manner. If heated water is desired, coupler 12 may be attached to a hot water tap or alternatively, pipe 14, in its extension between nozzle 16 and valve 20, may include an internal heating element, not shown, of high amperage and controlled by push button 21 of valve 20 for spraying water or steam of a desired temperature.

Figure 3:
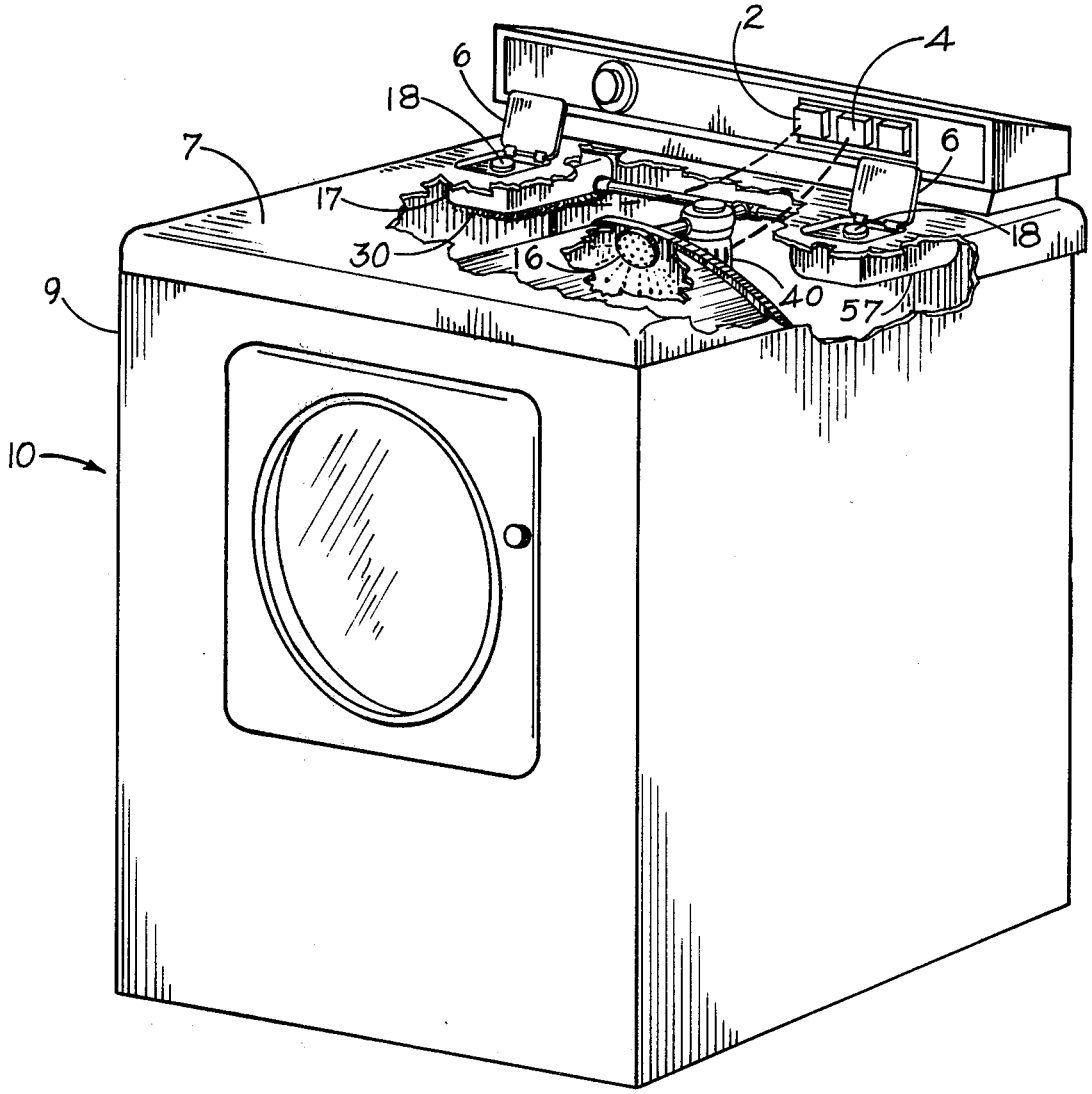
FIG. 3 is a perspective view of a dryer including a second embodiment of the improvement of the present invention.

Referring now to FIG. 3, another embodiment of the invention may be seen to advantage. The apparatus as shown in the figure includes a self-contained water reservoir 17 which is mounted to external housing 9 of dryer 10, preferably adjacent the top 7 of the dryer for convenient filling. Reservoir 17 may be provided with a screw cap 18 threaded into the top of the reservoir to provide access for filling the reservoir. A cover lid 6, hingeably engaging top surface 7 of the dryer, may also be provided to enhance the appearance of the dryer and to provide a level working surface on the dryer top. Reservoir 17 may be further equipped with a heating element, as for example heating coil 30, and a suitable thermostat to provide water of a selected temperature for spraying. On-Off swith 2 is operable to control flow of electricity to the heating coil as is indicated by the dotted line therebetween. In a gas dryer, reservoir 17 may be heated by a gas burner, either separate or in combination with the primary burner of the dryer. Water held in reservoir 17 may be discharged directly through spray nozzle 16 and controlled by a suitable valve; one such suitable valve being shown in FIG. 2; or, as preferred, may be discharged through the nozzle by means of a motor and pump unit, disignated generally by the numeral 40, for superior spray action. The motor and pump unit, conventional in nature, may be controlled by a push button switch 4, mounted on the control panel of the dryer and electrically connected to the motor-pump unit, as shown by the dotted line therebetween.

A second reservoir 57, substantially similar to reservoir 17 in the preferred embodiment, also mounted to external housing 9 of dryer 10 may be provided for dispensing desired additives. Reservoir 57 may be coupled to reservoir 17 and to either the valve control or the motor-pump unit 40 by means of a tee-joint 58, as shown in the drawing.

In using the apparatus as shown in FIG. 1, and assuming wrinkled permanent press clothing to be in the dryer, the tumbler of the dryer is activated in the usual way for a short period of time on the permanent press cycle. Immediately after tumbling begins, the operator simply depresses button 21 of valve 20 for a short period. Water then flows through connecting pipe 3, under tap pressure, through pipe 14, through valve 20, and is discharged in a fine mist upon clothing within the tumbler. The length of time required in the depression of button 21 is dependent upon several factors, including water pressure and line size, as well as the number and size of apertures in nozzle 16. The wrinkle-free clothing may then be removed after a short period of tumbling and drying.

In operation of the embodiment as shown in FIG. 3, reservoir 17 is first filled with clean water and reservoir 57 may be similarly filled with a selected additive or combination of additives such as fabric softeners or static electricity removers. Caps 18 may then be replaced and cover lid 6 lowered to a horizontal position. Wrinkled fabrics within the dryer may be dampened, as before explained, by pressing button 4 which activates motor and pump unit 40 to withdraw liquids from reservoir 17 and 57 and spray the liquid or mixture of liquids so withdrawn into a fine mist over clothes or fabrics about to be tumbled or tumbling in dryer 10. Should it be desired that water contained in reservoir 17 be heated, button 2 is depressed, thereby activating heating coils 30 to heat the water. The coils will continue to heat until the water reaches a desired temperature as monitored by the thermostat.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. An improved clothes drying apparatus of the type in which clothes or other fabrics are tumbled in a substantially cylindrical tumbler which is rotatably mounted about a horizontal axis within an external housing having a stationary clothes retaining back wall and an access door, wherein the improvement comprises:

a liquid supply source;

a liquid discharge nozzle operable to spray fabric material within the tumbler, said nozzle affixed to the front surface of the clothes retaining back wall substantially flush with said surface; and liquid conveyance means extending between the interior and exterior of said tumbler through said backwall and connecting said supply source with said nozzle.

2. The apparatus as described in claim 1 further comprising manual control means operable to regulate the amount of liquid dispensed, connected to said conveyance means.

3. The apparatus as described in claim 1 further comprising at least one liquid additive supply source mounted to said external housing and connected to and in fluid communication with said nozzle.

4. The apparatus as described in claim 1 wherein said liquid supply source is a household water tap.

5. The apparatus as described in claim 1 further comprising liquid heating means mounted to said housing and operable to pre-heat liquid dispensed through said nozzle.

* * * * *